US008752247B2

(12) United States Patent
Franchini

(10) Patent No.: US 8,752,247 B2
(45) Date of Patent: Jun. 17, 2014

(54) HINGE WITH DEFINED HALT POSITIONS

(75) Inventor: Gian Carlo Franchini, Correggio (IT)

(73) Assignee: Elesa S.p.A., Milan (IT)

( * ) Notice: Subject to any disclaimer, the term of this patent is extended or adjusted under 35 U.S.C. 154(b) by 0 days.

(21) Appl. No.: 13/582,233

(22) PCT Filed: Mar. 4, 2011

(86) PCT No.: PCT/IB2011/050936
§ 371 (c)(1),
(2), (4) Date: Oct. 12, 2012

(87) PCT Pub. No.: WO2011/107971
PCT Pub. Date: Sep. 9, 2011

(65) Prior Publication Data

US 2013/0074287 A1 Mar. 28, 2013

(30) Foreign Application Priority Data

Mar. 4, 2010 (IT) ..... MI2010A0351

(51) Int. Cl.
*E05D 11/10* (2006.01)
*E05D 11/00* (2006.01)

(52) U.S. Cl.
USPC ..... 16/334; 16/342

(58) Field of Classification Search
USPC ..... 16/334, 342, 344, 331, 332, 295, 299, 16/300, 301
See application file for complete search history.

(56) References Cited

U.S. PATENT DOCUMENTS

| | | | | | |
|---|---|---|---|---|---|
| 36,976 | A * | 11/1862 | Acker | ..... | 16/300 |
| 345,905 | A * | 7/1886 | Kochsmeier et al. | ..... | 16/295 |
| 384,102 | A * | 6/1888 | Warner | ..... | 16/295 |
| 3,825,973 | A * | 7/1974 | Gwozdz | ..... | 16/300 |
| 4,501,045 | A * | 2/1985 | Boyer | ..... | 16/331 |
| 5,412,842 | A * | 5/1995 | Riblett | ..... | 16/334 |
| 5,765,263 | A * | 6/1998 | Bolinas et al. | ..... | 16/342 |
| 5,918,347 | A * | 7/1999 | Morawetz | ..... | 16/322 |
| 6,182,330 | B1 * | 2/2001 | Novin et al. | ..... | 16/341 |
| 6,256,839 | B1 * | 7/2001 | Wu | ..... | 16/366 |
| 6,497,005 | B2 * | 12/2002 | Apostoloff | ..... | 16/375 |

(Continued)

FOREIGN PATENT DOCUMENTS

| | | | |
|---|---|---|---|
| DE | 19728641 | A1 | 1/1998 |
| GB | 385906 | A | 1/1933 |
| IT | MI20051260 | A1 | 1/2007 |
| WO | 2007-112365 | A2 | 10/2007 |

OTHER PUBLICATIONS

International Search Report for PCT/IB2011/050936; Jul. 1, 2011.

*Primary Examiner* — Victor Batson
*Assistant Examiner* — Jason W San
(74) *Attorney, Agent, or Firm* — Pearne & Gordon LLP

(57) ABSTRACT

Hinge for supporting and maneuvering doors, consisting of two wing-shaped elements, provided with means for the attachment to a frame part and to a door part, respectively, as well as with means for the mutual hinging of in a pivoting area, said means consisting of appendixes projecting from said wing-shaped elements, characterized in that at least one of said appendixes of a first one of said wings is shaped as a cylindrical body on the surface of which there are formed axial grooves, at a preset, mutual, circumferential distance, and in that with a second one of said wings, opposite to said appendix, there is associated at least one thrust-engagement element in one of said grooves, at least partly elastically yielding.

10 Claims, 4 Drawing Sheets

(56) References Cited

U.S. PATENT DOCUMENTS

| | | | | |
|---|---|---|---|---|
| 6,609,273 | B1 * | 8/2003 | Yamada et al. | 16/332 |
| 7,210,199 | B2 * | 5/2007 | Clark | 16/299 |
| 7,461,432 | B2 * | 12/2008 | Lowen et al. | 16/334 |
| 7,735,196 | B2 * | 6/2010 | Centmayer et al. | 16/334 |
| 8,069,535 | B2 * | 12/2011 | Tang | 16/342 |
| 8,082,627 | B2 * | 12/2011 | Chien | 16/342 |
| 8,099,834 | B2 * | 1/2012 | Corso et al. | 16/374 |
| 8,209,816 | B2 * | 7/2012 | Heger et al. | 16/334 |
| 8,245,353 | B2 * | 8/2012 | Homner et al. | 16/299 |
| 8,307,513 | B1 * | 11/2012 | Fitzgerald | 16/386 |
| 8,347,460 | B2 * | 1/2013 | Minegishi | 16/333 |
| 2005/0134984 | A1 * | 6/2005 | Kuo | 359/879 |
| 2007/0234517 | A1 * | 10/2007 | Larson et al. | 16/342 |
| 2010/0050386 | A1 * | 3/2010 | Wang et al. | 16/334 |
| 2010/0251520 | A1 * | 10/2010 | Corso et al. | 16/342 |
| 2013/0074287 | A1 * | 3/2013 | Franchini | 16/292 |

* cited by examiner

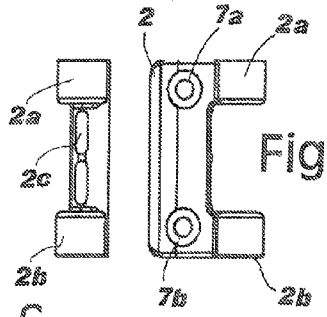
Fig. 5
Fig. 6
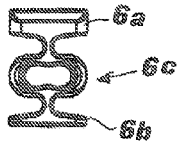
Fig. 7
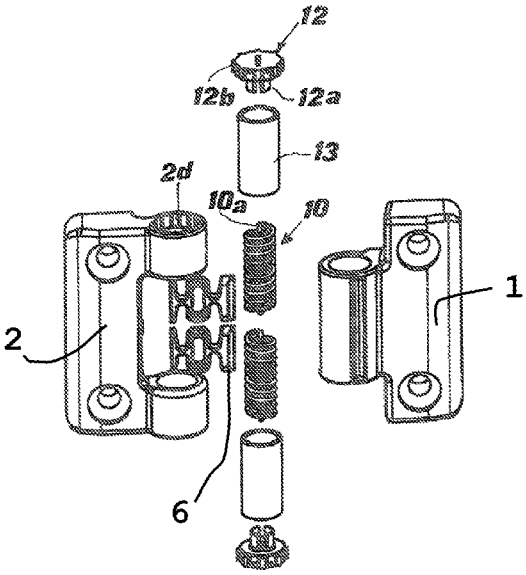
Fig. 10
Fig. 12
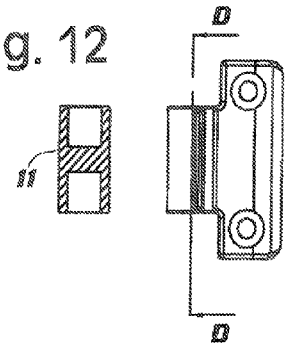
Fig. 11
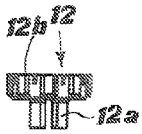
Fig. 13

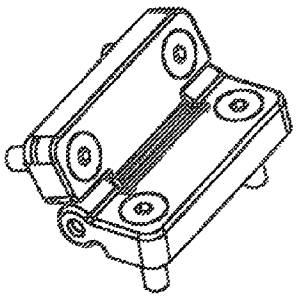
Fig. 14b
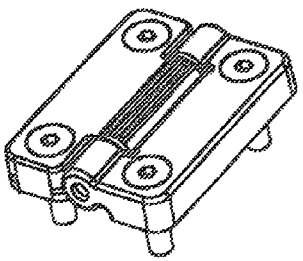
Fig. 14d
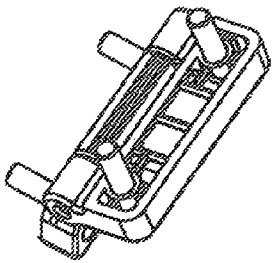
Fig. 14a
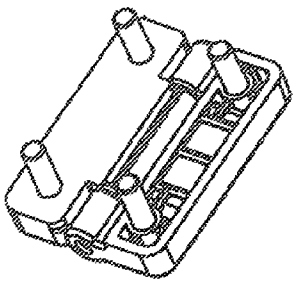
Fig. 14c
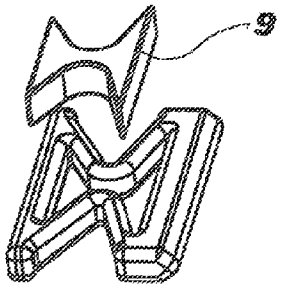
Fig. 9
Fig. 8
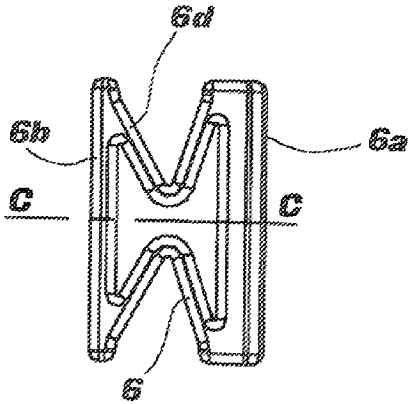
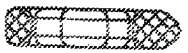
Fig. 8a

HINGE WITH DEFINED HALT POSITIONS

BACKGROUND ART

The present invention concerns a hinge which has multiple halt positions, i.e. a hinge which can remain stationary in an intermediate position without the help of outer mechanical supports, such as for example hooks, chains, or other elements which need to be mounted.

Hinges of this type are available on the market, and they are employed in industrial equipment, for example for the connection of hoods of mechanical equipment to the frame, or of doors to automatic vending machines, to electric cabinets, to banking devices, or in protection carters, access gates or the like.

As can be easily understood, this type of hinge was met with considerable success on the market, also in the light of the fact that it meets the need of operators and maintenance personnel of having a gate, or a hood, which keeps an open, secure position, however chosen, and that it does not interfere—if only incidentally—with the action thereof.

The hinges thus made found on the market provide a system of mutual engagement of two hinge elements, consisting of locking elements between a central pivot and one—or both—hinge elements. Thrust springs are provided, made of steel or rubber, which are associated with further additional elements, such as for example steel spheres and screws.

U.S. Pat. No. 5,412,842 owned by Southco Inc. concerns for example a conventional-type hinge, wherein suitable means are provided apt to retain in specific mutual positions the two hinge wings. Said devices consist of a spring-sphere pair, housed in the wall-fastened wing, and of holes and grooves provided on the wings so that the sphere-shaft coupling keeps the door in a predefined secure position, unless a strong pressure is imparted on the gate.

However, such a solution is particularly complex to accomplish, since all the recesses obtained must be perfectly in axis to be able to effectively lock the gate, and since rather difficult mounting operations are necessary, with the risk that the sphere departs from its seat during the installation.

In order to make the hinge structure simpler, the Applicant duly submitted Italian patent no. 1365898, aimed at protecting a hinge having multiple halt positions, the hinging elements of which provided on the respective wings have on the engagement surfaces ribs and longitudinal recesses in mutual engagement. This invention, which substantially provided to insert no retaining element, proved particularly useful in case of relatively light loads, but it highlighted some problems on heavier loads.

It is therefore an object of the present invention to find a new hinge type with defined halt positions which is capable of overcoming the above-said disadvantages, and in particular which provides a sealing system easy to manufacture and mount, which is capable of keeping the hinge in a secure position when it is in the desired preset position, with no limitation to the borne load.

The above-said objects are achieved through a hinge for door support and maneuvering, consisting of two wing elements, provided with means for fastening to a frame part and to a door part, respectively, as well as mutual-hinging means in a pivoting area, said means consisting of appendixes projecting from said wing elements, wherein at least one of said appendixes of a first one of said wings is shaped as a cylindrical body on the surface of which axial grooves are formed, at a preset circumferential mutual distance, and in that with a second one of said wings, opposite to said appendix, at least one element of thrust engagement is associated in one of said grooves, at least partly elastically yielding.

According to a second main feature of the invention, the element of thrust engagement consists of a pair of ribs parallel to the hinge pivoting axis, kept together by elastically yielding connection means. In particular, one of said ribs intended for engagement with a respective one of said grooves, has a substantially polygonal section, with an angle forming an engagement wedge.

According to a further feature of the invention, the elastically yielding connection means consist of elements forming a closed broken line having a symmetrical configuration with respect to a median axis, perpendicular to the two ribs. Preferably, the closed broken line consists of an elliptical, curved line with its major axis parallel to the two ribs.

According to a further alternative feature, the elastically yielding connection means consist of a pair of elements, each one substantially V-shaped, opposite by their vertexes.

According to a further feature, torsion spring means are furthermore provided, housed in correspondence of the pivoting area and arranged to push the door always in a secure position, consisting of:

a pair of coaxially opposite springs, kept separate, but in mutual engagement at their respective proximal ends, by a double-prong retaining element, said element being anchored to a first one of said wing elements, said springs being anchored with their distal ends on a pair of bottoms closing the outer ends of a second one of said wing elements. The above-said bottoms are engaged with the respective end of said second wing element, said engagement being accomplished through protrusions provided at regular intervals on the outer circumferential edge of the bottom and by recesses housing said protrusions, respectively, provided on the inner circumferential edge of the respective end of the wing element.

Other features and advantages of the invention will in any case be more evident from the following detailed description of some preferred embodiments, given purely by way of a non-limiting example, and illustrated in the attacked drawings, wherein:

FIG. 1 shows a front view of the hinge according to the invention, of which

FIG. 3 is a front view of one of the two bodies making up the hinge of FIG. 1, of which

FIG. 5 is a front view of the other body making up the hinge of FIG. 1, of which FIG. 6 is a side view along the area of engagement with the other wing;

FIG. 7 is a perspective view of the thrust engagement device according to a first embodiment of the invention;

FIG. 8 is the perspective view of the thrust engagement device mounted in the hinge according to a second embodiment of the invention, of which FIG. 8*a* is the section view along line C-C;

FIG. 9 is the perspective exploded view of an alternative embodiment of the thrust engagement device mounted in the hinge according to the invention;

FIG. 10 is the exploded view of a third embodiment of the hinge according to the invention;

FIG. 11 is the front view of an element making up the hinge of a third embodiment of the invention, of which FIG. 12 is a section view along line D-D;

FIG. 13 is the side view of a closing cap of the pivot area of the hinge of FIG. 10;

Figure 1:
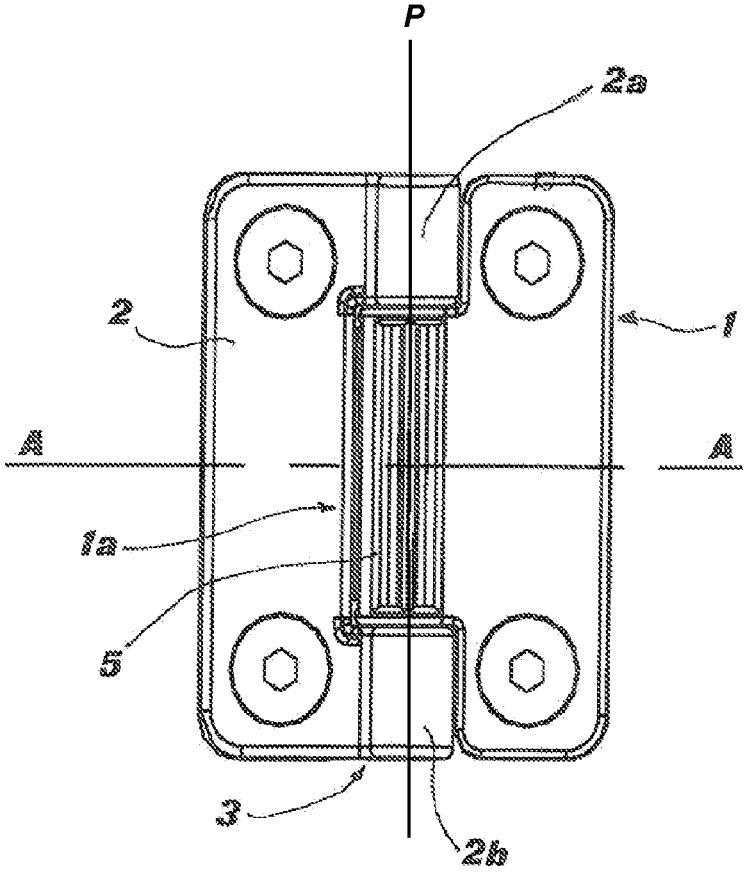
Figure 2:
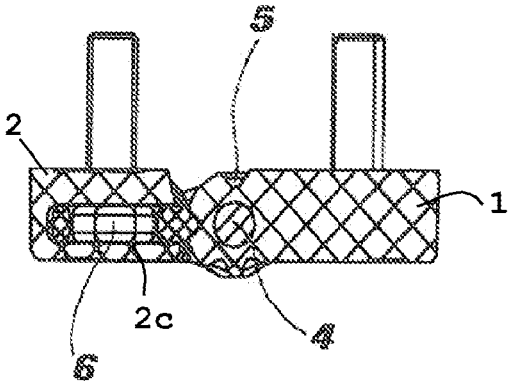
FIG. 2 is a section view along line A-A.
Figure 3:
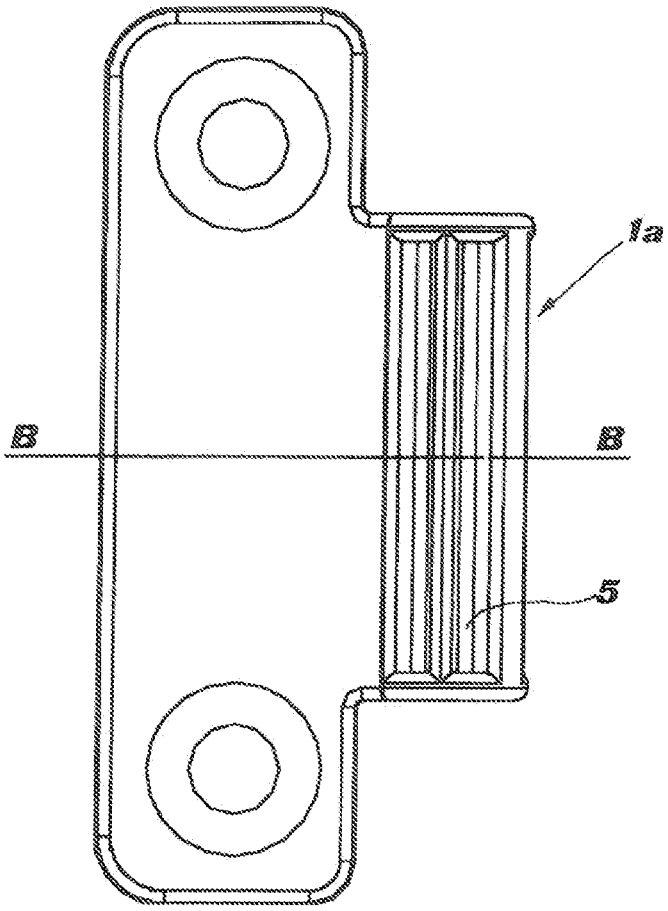

FIGS. 14*a* to 14*d* are perspective views aimed at showing the positions which the various embodiments of the hinge according to the invention can take up during operation, with various angles.

The hinge according to the invention consists of two main elements 1 and 2, which can be identified as wings or as hinge bodies—generally molded of thermoplastic material, but which can be made also of other synthetic materials, or of rubber or of metal—shaped so as to have a mutual engagement area 3, into which a pivoting element 4 is introduced.

The mutual engagement area 3 consists of the association of respective appendixes which project from both wings: in particular a cylindrical body 1*a* projecting from wing 1 is provided, and a pair of bushes 2*a*, 2*b*, projecting from wing 2, for the introduction and the sealing of pivoting element 4. Pivoting element 4 is axially mounted starting from one of the ends and is fastened by means of constraint elements (not shown, known per se).

Cylindrical body 1*a* has a surface with axial grooves 5, mutually distanced on the circumference. The above-said grooves 5 preferably have a rounded profile.

Figure 4:
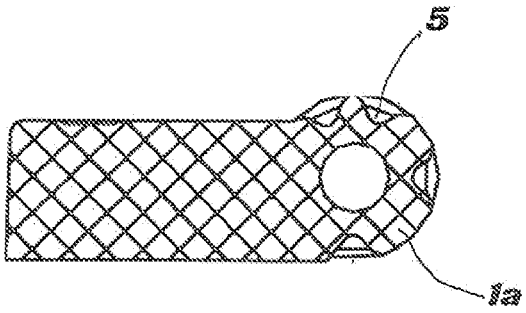
FIG. 4 is a section view along line B-B.

As can be understood from FIG. 4, body 1*a* has a particular arrangement of grooves 5: with the support plane of body 1 these form angles corresponding to those which the hinged door will take up with respect to the wall whereon the hinge is mounted. In particular, in FIG. 4 the four preferred positions are shown, coinciding with those usually requested by operators, i.e.: position a) at −90°, position b) at 0°, position c) at +70° and position d) at +115°.

Along the surface of wing 2 which lies opposite cylindrical body 1*a* of wing 1, at least one groove 2*c* is obtained, for the housing of a thrust and engagement element 6, suitably shaped so that it partly engages with groove 5 and so that it guarantees that no undesired hinge rotation takes place.

Thrust and engagement element 6 consists of a pair of ribs (6*a*, 6*b*) parallel to the hinge pivoting axis A, kept together by elastically yielding connection means (6*c*) to allow the introduction and sealing of the engagement with groove 5. In particular, rib 6*a* is apt to be engaged with the grooves 5 provided on body 1*a*, has a substantially polygonal section, more precisely irregularly pentagonal, with one of the angles more closed, forming a substantially pentagonal wedge, i.e. it ends with a wedge-like profile, so as to make the engagement with groove 5 more secure, and at the same time to aid disengagement when sufficient force is imparted on it. Rib 6*b* instead has a substantially rectangular shape, is intended to be introduced into said groove 2*c*, where it is retained by pressure.

From this basic configuration, various embodiments of the invention may be provided, some of which are here described for a better understanding of the invention.

As is clearly shown in FIG. 6, in one of the preferred embodiments a pair of parallel grooves 2*c* is provided along the inner wall of wing 2. Such grooves are apt to the housing of thrust and engagement element 6, arranged between the two crosswise recesses 7*a*, 7*b* provided for the introduction of tightening screws.

FIG. 7 shows a particularly preferred shape of thrust and engagement element 6, wherein an element forming a closed curved line, having a substantially elliptical configuration can be recognized as being arranged between ribs 6*a*, 6*b*.

In order to improve its elastic properties, thrust and engagement element 6*c* is arranged so that its major axis is parallel to the two ribs 6*a*, 6*b*.

It can be clearly understood that the number and the size of grooves 2*c* depends on the shape taken up by thrust and engagement element 6: as a matter of fact, grooves 2*c* are modular and can be reproduced by the entire hinge length.

In an alternative embodiment of the invention, thrust and engagement element 6 has a general X-shaped configuration, the arms of which are elastically yielding. In particular, it consists of a pair of mutually parallel ribs 6*a*, 6*b*, kept together by connection elements 6*d*, 6*e*, having a shape substantially as opposite-by-the-vertexes Vs. More precisely, connection elements 6*d*, 6*e* are V-shaped, with the vertex widely connected in an arc form, which determines their calibrated flexibility. V-elements 6*d*, 6*e* depart from the ends of ribs 6*a*, 6*b* and converge with the vertexes in the middle.

By exploiting the combination between the mechanical/plastic features of the material of which it is made and its geometrical configuration, thrust and engagement element 6 forms a snap-engagement system with grooves 5, for which the rotation of wing 2 with respect to wing 1 leads to the introduction of rib 6*a* of the thrust and engagement element 6 into the various grooves 5 of element 1. Should one wish to change the relative position of one wing with respect to the other one, it will be sufficient to rotate one wing with respect to the other one imparting such a pressure as to cause rib 6*a* to prise out of groove 5 wherein it lies and engage with adjacent groove 5.

The alternative embodiment illustrated in FIG. 9 provides the use of a dampening element 9, suitably shaped so that it may be introduced into the area lying between the two vertexes of V-shaped elements 6*d*, 6*e* of thrust and engagement element 6.

The dampening element 9 thus made and arranged is substantially apt to increase the elastic resistance of thrust and engagement element 6. Such a structure, arranged in association with the vertexes of V-shaped elements 6*d*, 6*e*, serves to increase the sealing of the hinge, in case the application requires it. In practice, it was detected that the addition of said dampening element 9 is capable of guaranteeing also a "softer" behavior of thrust and engagement element 6, therefore dampening the impact upon door opening or closing.

In a further embodiment, which has an improvement variant applicable to both preceding ones, it is finally provided the presence of torsion spring means, housed in correspondence of the pivoting area and arranged to push the door always into a secure position, corresponding to the engagement 6 with one of grooves 5.

As illustrated in FIG. 10, said torsion spring means consist of a pair of coaxially opposite springs 10, kept separate, but in mutual engagement at their respective proximal ends, by a double-prong retaining element 11. With reference to one o such springs, the other spring being specular to the first one, the distal end 10*a* is fastened, against rotation, to a bottom 12 closing the bush of wing 2; according to a preferred embodiment, from the surface of bottom 12 a pair of pins 12*a* projects, between which an engagement space of the spring end portion is formed.

Moreover, bottom 12 is manufactured to be removable from the outer ends of the bush of wing 2. Moreover, in order to guarantee the secure retaining of bottom 12, an engagement with respective seats provided on the inner contour of the bush edge of wing 2 is provided; for such purpose, protrusions 12*b* are provided at regular intervals on the outer circumferential edge of bottom 12 and recesses 2*d* for the housing of said protrusions on the inner circumferential edge of said seat, respectively, of the respective end of the wing element.

The embodiments reported here are those which can be more readily understood, and are therefore the most representative of the new additional structure provided.

However, it can be understood that thrust and engagement element 6, and consequently dampening element 9, may take up other shapes, achieving the same usefulness. For example, it is possible to provide to establish any symmetrical, closed, broken line along the axis perpendicular to the two ribs, so that in any case an even distribution of the elastic force is guaranteed when the hinge moves.

It is also possible to symmetrically introduce on the outer surfaces of the letter V of said V-shaped elements 6*d*, 6*e* two identical dampening elements 9 which impart the required force.

As can be understood from FIGS. 14*a*-14*d*, thrust and engagement element 6 has been manufactured so that, when it is in its home position, it thrusts within one of grooves 5, in pre-load conditions. When the operator removes the door, thrust and engagement element 6 is moved out of the groove, loading and scraping the outer part of body 1*a*, until it finds the next groove, into which to arrange itself precisely in a pre-loading position. For the door to be able to move, it is hence necessary that the operator imparts a torque proportional to the hardness of thrust and engagement element 6.

In the case of the third embodiment, moving the door, and consequently the wing connected thereto, determines the loading of the spring contained within the pivoting area. This behaviour causes the fact that—when the door is released—the spring imparts a force opposite to the one of the torsion just experienced and tends to bring the door towards the home position. The introduction of thrust and engagement element 6 into groove 5, however, determines the door halt in a secure position. It can therefore be understood that this solution further guarantees that maintenance and maneuvering operations in the area protected by the door can occur without the risk of undesirable movements of the door, for example due to distraction by the operator, who has mistakenly thought he had correctly locked the hinge. It can therefore also be understood that the material making up the yielding elements will have different features of mix and hardness depending on requirements, so as to guarantee the desired final torque on the hinge.

In order to achieve the best performances, and guarantee the desired physical-mechanical properties, thrust and engagement element 6 is preferably made of an acetalic resin. However, it can be understood that the hinge can be made of any material having a suitable capability of elastic deformation. From the preceding description it can be easily understood that, by the invention, a system capable of maintaining a secure engagement has been accomplished, and at the same time of providing various positions of equilibrium, between the two wings, achieving a simple, inexpensive and durable elastic system.

It can therefore be understood that the particular hinge configuration adopted guarantees remarkable advantages, which are appreciate by field operators.

In particular, it has a high resistant torque, greater than the ones normally available on the market: this enables operators to use it also for supporting any kind of load, in particular of doors rotating about a horizontal axis, kept in an open position. As can be easily guessed, this implies also the fact that it is no longer necessary to use other mechanical support devices such as gas springs, linear rails, etc., usually provided in order to guarantee stability. For the above-reported reasons, and for the particular snap-engagement configuration, which guarantees that there are no accidental movements of the door, the hinge just described has special safety requirements which are appreciated by operators. Finally, the rounded configuration of grooves 5 enables the operator to carry out maintenance and cleaning operations of the simplified hinge.

Understandably, the hinge described so far may be subject to modifications, without departing from the scope of protection of the present invention. For example, depending on requirements, it is possible to adjust the position of grooves 5, simply by changing the contour of the mold so as to obtain the desired angles.

It is understood that the protection of the invention described above must not be considered limited to the described embodiment, but extend to any other construction variant which achieves the same usefulness.

For example, pivot 4 may take up any one of the shapes of pivots of the majority of hinges; similarly, the constraint elements which keep it in a stationary and secure position can be for example an annular milled area, an undercut edge or any one other system. These elements are in no way involved in the snap-locking operations of the hinge and are therefore not subject of the present invention.

In particular, pivot 4 may be manufactured in shape of a pair of tubular bush bodies 13, having such a size as to house in their inside springs 10, and to act as retaining element for the pins 12*a* of bottom 12.

As can be easily understood, all the elements making up the hinge may consist of any type of material which can offer the desired features of lightness and resistance.

Moreover, the angles which the hinge may take up during operation may also differ from those shown in the drawings.

The invention claimed is:

1. A hinge for supporting and maneuvering doors, consisting of two wing-shaped elements for fastening to a frame part and to a door part respectively, each of said wing-shaped elements including at least one appendix projecting therefrom, a hinge pin pivotally connecting said wing-shaped elements together for fastening to a frame part and to a door part, respectively, and for mutual hinging about a pivoting axis in a pivoting area, wherein at least one of said appendixes of a first one of said wings is shaped as a cylindrical body on the surface of which there are formed axial grooves, said grooves being disposed at a circumferential distance from each other, and in that with a second one of said wings, opposite to said at least one of said appendixes, there is at least one push element engagement with one of said grooves, at least partially elastically yielding for selective engagement with one of said grooves to prevent undesired hinge rotation, and wherein said at least one push element consists of a pair of ribs parallel to the pivoting axis of the hinge, said ribs being kept together by elastically yielding connecting elements.

2. The hinge as claimed in claim 1, wherein one of said ribs intended for engagement with a respective one of said grooves, has a substantially polygonal section, with an angle forming an engagement wedge.

3. The hinge as claimed in claim 1, wherein said elastically yielding connection elements consist of elements each forming a closed, curved line having a symmetrical configuration with respect to a median axis perpendicular to said two ribs.

4. The hinge as claimed in claim 3, wherein said curved line is an ellipsis having its major axis parallel to said two ribs.

5. The hinge as claimed in claim 1, wherein said elastically yielding connection elements consist of a pair of elements, each being substantially V-shaped, opposite by their vertexes.

6. The hinge as claimed in claim 5, wherein each of said V-shaped connection elements has a vertex widely connected in an arc shape, said connection elements departing from the ribs ends and converging with their vertexes to the center.

7. The hinge as claimed in claim 1, wherein said connecting elements further comprises at least one dampening element shaped to engage the inner contours of said connection elements.

8. The hinge as claimed in claim 1, wherein said hinge pin further comprises at least one torsion spring housed in correspondence of the pivoting area and prepared to always push the wing-shaped elements into a secure position corresponding to the engagement of said push element with one of the grooves.

9. The hinge as claimed in claim 8, wherein said at least one torsion spring consist of:

a pair of coaxially opposite springs, kept separate, but in mutual engagement at their respective proximal ends, by a double-prong retaining element, said element being anchored to a first one of said wing elements, said springs being anchored with their distal ends on a pair of bottoms closing the outer ends of said second one of said wing elements.

10. The hinge as claimed in claim 9, wherein at least one of said bottoms is engaged with a respective end of said second wing element, said mutual engagement being accomplished by protrusions provided at regular intervals on the outer circumferential edge of the at least one of sad bottoms and by recesses housing said protrusions, respectively, provided on the inner circumferential edge of said respective end of the second wing element.

* * * * *

UNITED STATES PATENT AND TRADEMARK OFFICE

CERTIFICATE OF CORRECTION

PATENT NO. : 8,752,247 B2
APPLICATION NO. : 13/582233
DATED : June 17, 2014
INVENTOR(S) : Gian Carlo Franchini It is certified that error appears in the above-identified patent and that said Letters Patent is hereby corrected as shown below:

In the Claims

Column 7, claim 10, line 26, the word “sad” should read --said--.

Signed and Sealed this
Twenty-third Day of September, 2014

Michelle K. Lee

Michelle K. Lee
*Deputy Director of the United States Patent and Trademark Office*